US010154687B2

(12) United States Patent
Volgger et al.

(10) Patent No.: US 10,154,687 B2
(45) Date of Patent: Dec. 18, 2018

(54) CIGARETTE PAPER THAT GIVES A CIGARETTE A UNIFORM DRAWING PROFILE

(71) Applicant: delfortgroup AG, Traun (AT)

(72) Inventors: Dietmar Volgger, Schwaz (AT); Stefan Bachmann, Fulpmes (AT)

(73) Assignee: delfortgroup AG, Traun (AT)

( * ) Notice: Subject to any disclaimer, the term of this patent is extended or adjusted under 35 U.S.C. 154(b) by 43 days.

(21) Appl. No.: 14/895,339

(22) PCT Filed: May 21, 2014

(86) PCT No.: PCT/EP2014/060445
§ 371 (c)(1),
(2) Date: Dec. 2, 2015

(87) PCT Pub. No.: WO2014/202319
PCT Pub. Date: Dec. 24, 2014

(65) Prior Publication Data

US 2016/0120214 A1 May 5, 2016

(30) Foreign Application Priority Data

Jun. 21, 2013 (DE) ..... 10 2013 106 516

(51) Int. Cl.
*A24D 1/02* (2006.01)
*D21H 11/12* (2006.01)
(Continued)

(52) U.S. Cl.
CPC ..... *A24D 1/025* (2013.01); *A24C 5/005* (2013.01); *A24D 1/02* (2013.01); *D21H 11/12* (2013.01);
(Continued)

(58) Field of Classification Search
CPC ..... A24D 1/025; A24C 5/005
(Continued)

(56) References Cited

U.S. PATENT DOCUMENTS 1,605,085 A * 11/1926 Unger ..... D21H 5/16 131/276
3,667,479 A 6/1972 Sanford ..... 131/15
(Continued)

FOREIGN PATENT DOCUMENTS

DE 69806286 T2 10/2002 ..... A24D 1/02
DE 102009030546 B3 1/2011 ..... A24C 5/00
(Continued)

OTHER PUBLICATIONS

Benedek, Istavan. Pressure-Sensitive Adhesives and Applications (pp. 589). CRC Press, 2004.*
(Continued)

*Primary Examiner* — Michael H. Wilson
*Assistant Examiner* — Russell E Sparks
(74) *Attorney, Agent, or Firm* — Sunstein Kann Murphy & Timbers LLP

(57) ABSTRACT

A cigarette paper is disclosed that contains at least one burn additive the concentration c(x) of which varies along a direction x of the cigarette paper. For the position-dependent concentration c(x) over an interval of length L, for x over the interval [0,L], $f(x)-\Delta c \leq c(x) \leq f(x)+\Delta c$. In this regard, 3 cm≤L≤11 cm, f(x) is monotonic over the interval [0,L], but not a constant function over the entire interval, and Δc≤1% by weight, preferably ≤0.7% by weight and particularly preferably ≤0.5% by weight, and especially preferably ≤0.3% by weight and particularly preferably ≤0.15% by weight and Δc>0% by weight, each with respect to the mass of the cigarette paper.

30 Claims, 1 Drawing Sheet

(51) Int. Cl.

| | |
|---|---|
| ***D21H 17/66*** | (2006.01) |
| ***D21H 19/12*** | (2006.01) |
| ***D21H 21/14*** | (2006.01) |
| ***A24C 5/00*** | (2006.01) |
| *A24C 5/46* | (2006.01) |

(52) U.S. Cl.
CPC ..... *D21H 17/66* (2013.01); *D21H 19/12* (2013.01); *D21H 21/14* (2013.01)

(58) Field of Classification Search
USPC ..... 131/365
See application file for complete search history.

(56) References Cited

U.S. PATENT DOCUMENTS 3,744,496 A 7/1973 McCarty et al. ..... 131/8
3,911,932 A 10/1975 Houck, Jr. et al. ..... 131/15 B
4,187,862 A * 2/1980 Cohn ..... A24D 1/02 131/349
4,236,532 A * 12/1980 Schweizer ..... A24B 15/282 131/335
4,619,278 A * 10/1986 Smeed ..... A24C 5/38 131/284
4,726,385 A * 2/1988 Chumney, Jr. ..... A24D 3/043 131/198.2
5,168,884 A * 12/1992 Baldwin ..... A24D 1/02 131/336
9,149,068 B2 * 10/2015 Snow ..... A24D 1/025
2002/0179105 A1 12/2002 Zawadzki et al. ..... 131/365
2003/0070688 A1 * 4/2003 Aoki ..... A24B 15/28 131/364
2003/0131860 A1 * 7/2003 Ashcraft ..... A24D 1/025 131/365
2009/0120450 A1 5/2009 Herve et al. ..... 131/365

FOREIGN PATENT DOCUMENTS

DE 102010032814 A1 2/2012 ..... D21H 17/63
WO WO 2009/105343 A2 8/2009 ..... A24D 1/02

OTHER PUBLICATIONS

International Searching Authority, International Preliminary Report on Patentability—International Application No. PCT/EP2014/060445, dated Dec. 30, 2015, together with the Written Opinion of the International Searching Authority, 9 pages.
European Patent Office, International Search Report, International Application No. PCT/EP2014/060445, 11 pages, Sep. 9, 2014.

* cited by examiner

CIGARETTE PAPER THAT GIVES A CIGARETTE A UNIFORM DRAWING PROFILE

The present invention relates to a cigarette paper that provides a cigarette manufactured therefrom with a uniform puff profile. Further it relates to a process for producing such a cigarette paper, to a cigarette and to the use of a position-dependent concentration of burn additive in a cigarette.

BACKGROUND OF THE INVENTION

A typical cigarette comprises tobacco wrapped with cigarette paper and forms together with it a typically cylindrical tobacco rod. Attached to the tobacco rod is the filter that typically consists of cellulose acetate fibers. The filter and the tobacco rod are wrapped with the tipping paper. The tipping paper connects the filter to the tobacco rod. Aside from its function to wrap the tobacco, the cigarette paper must, inter alia, provide the cigarette with a pleasant outward appearance in the burnt and unburnt state and influence the smoldering speed of the cigarette. It also serves essentially to control the composition of the smoke, in particular the tar, nicotine and carbon monoxide content.

During smoking, the smoker generates a low pressure at the mouth end of the smoldering cigarette, by means of which air is on the one hand drawn through the glowing cone at the tip of the cigarette, but on the other hand also flows through the air-permeable cigarette paper into the tobacco rod and thus dilutes the smoke. The air flow flowing through the air permeable cigarette paper into the tobacco rod during smoking is called rod ventilation.

In the case in which the tipping paper is perforated, air flows through the tipping paper into the filter and also dilutes the smoke. This air flow is called filter ventilation.

Total dilution of the smoke can be broken down into the rod ventilation and the filter ventilation. During smoking and during free smoldering the tobacco rod is burnt, so that its length decreases. In this manner, the area of the cigarette paper available for rod ventilation is also reduced so that less and less air can flow through the cigarette paper into the tobacco rod and hence the rod ventilation decreases from puff to puff. To the same extent, the smoke is diluted less puff by puff and the concentration of the aerosols and gases that form the smoke increases in the smoke flowing out of the mouth end of the cigarette. Additionally, the tobacco rod has a certain filtration effect on the smoke that also decreases steadily with decreasing length of the tobacco rod. The smoker therefore gets the impression that the cigarette gets "stronger" from puff to puff.

This impression is undesirable and various measures are known in the prior art to mitigate it. As an example, the cigarette paper can be perforated, wherein the part of the cigarette paper lying close to the filter is perforated more strongly and has therefore higher air permeability than the remaining cigarette paper. In this manner, the rod ventilation does not decrease as strongly as for a cigarette paper with approximately constant air permeability along the tobacco rod. This procedure sometimes has the disadvantage that such cigarettes are hard to light, because a lot of air is flowing through the more strongly perforated part of the cigarette paper and the air flow through the tip of the cigarette is too small to start the smoldering process during lighting.

An alternative measure consists in coating the cigarette paper on the part further remote from the filter such that the air permeability of the coated areas is reduced and thereby areas of the tobacco rod are consumed first that contribute less to rod ventilation, as proposed in U.S. Pat. No. 3,911,932. Often, however, this measure will lead to a disproportionate increase of the carbon monoxide content in the smoke.

Furthermore in U.S. Pat. No. 3,667,479 it is proposed to coat the cigarette paper in parts of its area with strong oxidizing agents. During smoking the paper will be quickly thermally degraded in the coated areas and openings are created through which air can flow and dilute the smoke. The size or number of the areas increases in the direction towards the mouth end. The disadvantage is that such cigarettes provide a very bad ash appearance. After smoking, the tobacco ash of a cigarette is expected to remain as a white, cohesive column. Black stains and protruding ash particles or holes are not desirable. But coating parts of the area means that exactly such undesired holes are created.

Finally, for example, in U.S. Pat. No. 3,805,799 multilayer coatings of substances that are degradable and non-degradable by the smoke are proposed. Such solutions, however, are not prevalent.

BRIEF SUMMARY OF THE INVENTION

Thus, there exists further demand for options to achieve a uniform puff profile but that avoid the disadvantages in the prior art such as high carbon monoxide content in the smoke, bad ash appearance or inconveniences for the smoker during lighting of a cigarette.

This object is achieved by a cigarette paper according to claim 1, by a process for producing a cigarette paper with the following steps: providing a base cigarette paper, introducing at least one burn additive into the base cigarette paper in a position-dependent concentration c(x) that varies along a direction x of the cigarette paper, wherein for the position-dependent concentration c(x) over an interval of length L for x over the interval [0,L]:

$$f(x)-\Delta c \leq c(x) \leq f(x)+\Delta c$$

wherein:

$3\text{cm} \leq L \leq 11\text{cm}$, f(x) is monotonic over the interval [0,L], but not a constant function over the entire interval, and $\Delta c \leq 1\%$ by weight and $\Delta c \leq 0\%$ by weight, respectively with respect to the mass of the cigaretter paper, and $|f(L)-f(0)| \leq 2\Delta c$, by a cigarette with a tabacco rod and a cigarette paper that surrounds the tobacco rod, characterized in that the cigarette paper contains at least one burn additive the concentration of which varies along the longitudinal direction of the cigarette such that during machine-smoking the coefficient of variation of the tar and/or nicotine content over all puffs is less than for an otherwise identical cigarette with the same average burn additive content but with a uniform burn additive concentration along the longitudinal direction of the cigarette as well as the use of a position-dependent burn additive concentration in a cigarette to increase the uniformity of the puff profile of the smoke yields of tar and/or nicotine Advantageous embodiments are disclosed in the dependent claims.

According to the invention the cigarette paper is provided with burn additives and designed such that the content of one or more burn additives varies in the cigarette paper from the filter end to the tobacco end on a cigarette manufactured therefrom, in particular, such that it varies monotonically within usual production and measurement tolerances and hence either increases monotonically or decreases monotonically. The variation does not have to be strictly monotonic; thus, there can be areas with a constant content of the one or more burn additives. The variable content or the varying concentration of burn additives, respectively, is thereby selected such that the cigarette paper of a cigarette manufactured therefrom, in particular a filter cigarette, provides a more uniform puff profile than would be the case with an otherwise identical cigarette with a constant burn additive concentration along the longitudinal direction of the cigarette.

Burn additives are substances, for example, salts that can increase or reduce the smoldering speed of the cigarette paper. Very often, tri-sodium citrate and tri-potassium citrate or mixtures thereof are used. The group of burn additives with which the invention can be carried out, however, further comprises citrates, malates, tartrates, acetates, nitrates, succinates, fumarates, gluconates, glycolates, lactates, oxylates, salicylates, α-hydroxy caprylates, hydrogen carbonates, carbonates and phosphates and mixtures thereof. Tri-sodium citrate and tri-potassium citrate are examples of burn additives according to the invention that accelerate smoldering, hence are burn promoting, while phosphates can serve as an example for burn additives according to the invention that decelerate smoldering, hence are burn retarding. Whether a burn additive is burn promoting or burn retarding, is in general known to the skilled person or it can be easily determined by measuring the smoldering speed of a cigarette paper that contains the burn additive in question in a sufficient amount.

The influence of burn additives on smoke yields is highly complex and is not fully understood in the subject area. Nevertheless, the inventors have found that a more uniform puff profile can be obtained if the concentration c(x) of the at least one burn additive varies along a direction x of the cigarette paper, wherein for the position-dependent concentration c(x) over an interval of length L and for x over the interval [0, L]:

$$f(x)-\Delta c \leq c(x) \leq f(x)+\Delta c$$

wherein:

3 cm≤L≤11 cm, $f(x)$ is monotonic over the interval [0, L], but is not a constant function over the entire interval and Δc≤1% by weight, preferably ≤0.7% by weight, particularly preferably ≤0.5% by weight, and particularly highly preferably ≤0.3% by weight and in particular preferably ≤0.15% by weight and Δc>0% by weight respectively with respect to the weight of the cigarette paper.

The term concentration or burn additive content in the paper should be understood to mean the mass of the anhydrous burn additive in relation to the mass of the cigarette paper as used on the cigarette and is denoted as a % by weight. The direction x of the cigarette papers can but need not necessarily coincide with the machine direction.

The length L corresponds to the length of the visible tobacco rod on the cigarette, for which the cigarette paper is intended, i.e. the length from the point where the tobacco rod emerges under the tipping paper to the tip of the cigarette intended to be lit. This length L can differ for different cigarette brands, but as a rule will be ≤11 cm and ≥3 cm. The function $f(x)$ is monotonic over the interval [0,L], but does not necessarily need to be strictly monotonic. On the contrary, some of the presently preferred embodiments have sections in the area close to the filter and in the area of the tip that have a constant or essentially constant burn additive concentration c(x). In any case the function $f(x)$ is not constant over the entire interval.

Further, the actual burn additive concentration c(x) can deviate by a value of Δc from the monotonic function $f(x)$. This value dc accounts for the usual production and measurement tolerances of the burn additive content. Further, dc defines a corridor around an idealized function f(x) that still allows an improvement over a constant burn additive concentration, but possibly deviates locally to a moderate extent from the ideal monotonic profile.

As the influence of burn additives on the smoke yields is comparatively complex and not completely understood, the skilled person will determine the most suitable variation of the burn additive content by experiment. Nevertheless, extensive investigations by the inventors have shown that indeed in many cases the above mentioned monotonic or approximately monotonic variation of the burn additive concentration provides good results. In this regard, it was surprisingly found that such position-dependent concentrations c(x) for which the concentration increases from the filter end to the cigarette tip, as well as those for which the concentration decreases from the filter end to the cigarette tip, can provide an improved puff profile compared to a uniform burn additive distribution. In this regard, the invention indeed defines a class of cigarette papers that have the potential to substantially homogenize the puff profile.

This technical effect can be explained at least qualitatively. It is known that burn additives that are applied to the cigarette paper with a constant content influence the smoke yields of this cigarette. The relationship between the burn additive content and the smoke yields depends on the type of burn additives and can be simply determined by the skilled person for a specific individual case. Usually the relationship is non-linear.

For an important group of burn additives, in particular tri-sodium citrate and tri-potassium citrate, the following typical behavior can be found in such experiments: If the burn additive content is increased starting from a cigarette paper without burn additive, at first there is a decrease in the smoke yields. This reduction is arguably at least partially caused by the fact that the cigarette smolders faster and fewer puffs are taken. The inventors do not know which precise mechanisms cause this reduction.

If the burn additive content is increased further, the smoke yields decrease less and less and reach a minimum at a certain burn additive content. For papers with citrates as the burn additive the minimum for tar and nicotine is typically located at a burn additive content between 1.5% by weight and 5.0% by weight, for tri-sodium citrate typically at a burn additive content from 1.5% by weight to 3.0% by weight and for tri-potassium citrate at 3.5% by weight to 5.0% by weight, respectively with respect to the mass of the cigarette paper as used on the cigarette. With a further increase of the burn additive content the smoke yields, however, start to increase again. In spite of an increasing smoldering speed and thus a further decreasing number of puffs, the tar and nicotine content increases overall as well as per puff. Partially this may be attributed to the fact that the accelerated smoldering also burns more paper during a puff and thus the amount of tobacco consumed per puff increases in parallel. However, here again, the mechanisms are not entirely clear.

According to the invention this complex behavior is now exploited by selecting the interval and the profile of the burn additive content along the tobacco rod such that the smoke yields that normally increase puff by puff are compensated by the profile of the burn additive content.

For example, for tri-sodium citrate or tri-potassium citrate, this can be carried out in practice in at least two ways. A first possibility is to select the burn additive content at the filter end of the cigarette close to the value for which a minimum for tar and nicotine would be reached for an otherwise identical cigarette but with a constant burn additive content and then to let the burn additive content decrease at least approximately monotonically in the direction towards the end of cigarette that is to be lit.

A second possibility is to select the burn additive content at the filter end of the cigarette again close to the value for which a minimum for tar and nicotine can be obtained, but then to increase the burn additive content in the direction towards the end of the cigarette that is to be lit.

For both options the burn additive content that—at constant burn additive content—leads to the minimum tar and nicotine values is located in proximity to the filter end of the tobacco rod, thus in an area of the cigarette, that generates the "strongest" puffs during smoking, while those burn additive contents that—at constant burn additive content—lead to higher smoke yields, are located in the proximity of the end of the cigarette that is to be lit, hence where the puffs are rather "weak". The terms "strong" or "weak" puff should be understood to mean that the tar and nicotine smoke yields are higher or lower, respectively, with respect to other puffs on the same cigarette. In both cases, a monotonic variation of the burn additive content or burn additive concentration results over the length of the tobacco rod, however with different inclinations. In this regard, the monotonic or at least approximately monotonic burn additive concentration profiles actually define a universal class of burn additive profiles, with which more uniform puff profiles can be obtained. This can also be confirmed experimentally.

If a mixture of at least two different burn additives is present in the cigarette paper, the total burn additive content in the cigarette paper may be constant; however, the total content increases or decreases from the filter end to the tobacco end depending on which burn additive has the greatest effect on the puff profile.

For the monotonic function $f(x)$, preferably $|f(L)-f(0)|\geq 0.5\%$ by weight, preferably $\geq 1.0\%$ by weight and particularly preferably $\geq 22.0\%$ by weight. Preferably, $|f(L)-f(0)|\geq 2\Delta c$.

As mentioned above, L corresponds to the length of the visible tobacco on the associated cigarette, i.e. the length from the point where the tobacco rod emerges under the tipping paper to the tip of the cigarette that is to be lit. The variable x can be considered as a positional coordinate that runs from the point at which the tobacco rod emerges under the tipping paper, x=0, to the tip of the cigarette that is to be lit, x=L.

A preferred profile for the content of at least one burn additive provides a first optional area with a constant burn additive content, starting at the filter end of the visible tobacco rod, x=0, in the direction of the end of the cigarette that is to be lit, then followed by a linear increase or decrease of the content and finally again an optional area with a constant burn additive content.

Expressed in equivalent form, the cigarette paper is preferably designed such that for at least one burn additive with the content c(x) at position x the inequalities $$f(x)-\Delta c\leq c(x)\leq f(x)+\Delta c$$

hold for x over the interval [0,L] with $$f(x)=\begin{cases} c_0 & 0\leq x\leq L_1 \\ c_0+(c_L-c_0)\dfrac{x-L_1}{L_2-L_1} & L_1<x<L_2 \\ c_L & L_2\leq x\leq L \end{cases}$$

wherein, as explained below, special values have to be selected for $c_0$, $c_L$, $L_1$ and $L_2$.

The values $L_1$ and $L_2$ are to be determined such that the increase or decrease is neither too steep nor that it starts too early or too late. For $L_1$ an upper limit of 2L/3, preferably L/2 and particularly preferably L/3 has proved useful. As a lower limit for $L_1$ a value of 0 and preferably L/6 should be selected. Likewise the lower limit for $L_2$ should be selected to be L/3, preferably $L_2$ and particularly preferably 2L/3. The upper limit for $L_2$ can generally be set to L, preferably to 5L/6. In general, however, $L_1$ has always to be less than or equal to $L_2$.

Although the invention can be carried out in principle with a stepwise change of the burn additive content, i.e. $L_1=L_2$, this embodiment is not preferred. It is better to select the length of the increase or decrease of the burn additive content, $L_2-L_1$, to be greater than L/6, preferably greater than L/3 and particularly preferably greater than L/2. Of course, the length of the increase or decrease on the cigarette, $L_2-L_1$, cannot be greater than the length of the visible tobacco rod, so that an upper limit for the difference $L_2-L_1$ is defined by L. Preferably, however, a constant burn additive content can be provided close to the filter, as this area of the cigarette is rarely smoked. Analogously, an area of constant burn additive content can also be provided at the end of the cigarette that is to be lit, as this area burns all at once during lighting and thus influences the puff profile only very little. A preferred upper limit for the length of the decrease or increase, $L_2-L_1$, is hence 9L/10 and preferably 4L/5 and particularly preferably 2L/3.

The values for $c_0$ or $c_L$ should be greater than or equal to 0% by weight, preferably greater than 0.2% by weight and particularly preferably greater than 0.5% by weight. With regards to an upper limit for $c_0$ and $c_L$, 15% by weight is a possible choice, however 10% by weight is preferred and particularly preferably 7% by weight. In the case in which the at least one burn additive, the content of which varies on the cigarette paper is a citrate, 5% by weight has also proven to be a particularly preferred upper limit. These ranges are valid for $c_0$ and $c_L$, independently of each other. However, $c_0$ and $c_L$ must always differ from each other so that a variation in the burn additive content is actually present and preferably, the absolute difference of $c_0-c_L$ is greater than $2\Delta c$. The value for $\Delta c$ preferably in turn corresponds to the aforementioned values.

There are no limitations with respect to the geometrical distribution of the burn additives on the cigarette paper. Concerning the content of the at least one burn additive at a position x it should always be understood to be its average content in the circumferential direction on the cigarette on a strip with a width of L/10 and the position x in the middle of the strip. The sample size of the paper needed for the measurement of the burn additive content at a position x, for example, 1 g, will often have to be taken from several cigarettes, typically about five to ten cigarettes. Suitable methods for the determination of acetates, citrates or phosphates in cigarette paper can be found, for example, in the CORESTA Recommended Methods 33, 34 and 45.

Preferably, the cigarette paper is designed such that cigarettes can be manufactured therefrom that nominally have the same distribution of the content of at least one burn additive along the visible tobacco rod. This, for example, can mean that the cigarette paper is equipped with one or more marks that can be used to synchronize cutting of the tobacco rod with the profile of the burn additive content, the positions of which are thus in a pre-determined spatial relationship to the function c(x) for the burn additive content. The marks are preferably detectable by their effect on electro-magnetic waves; hence, for example, on transmission, reflection, refraction or absorption of visible light, ultra-violet light or infra-red radiation, and they can preferably be detected by an optical sensor, in particular by an optical sensor which reacts to reflected visible light. Preferably, these marks are placed on the cigarette paper such that on the finished cigarette they are located under the tipping paper and are thus not visible to the smoker.

An optional process consists in slightly coloring the composition with the one or more burn additives that is applied to the paper, and in applying a line or other mark that is easily detectable by a sensor at the location where the tipping paper overlaps the cigarette paper. Preferably the line or mark is printed onto the side that will subsequently face away from the tobacco, so that after production of the tobacco rod, the line or mark remains detectable by an optical sensor. In general, this is the upper side of the cigarette paper. It is also possible to apply the line or mark onto the side facing the tobacco; it is then recommended to detect the mark on the cigarette paper first before the tobacco rod is formed on the cigarette machine.

For the design of the profile of the content of the at least one burn additive the fact that on commercial cigarette machines a double cigarette is produced at first and then one of the halves is flipped over should preferably be taken into account. This can mean that the profile of the burn additive content c(x) is to be applied so as to periodically alternate in the machine direction of the cigarette paper, optionally with suitable intermediate displacements, in normal and in reverse direction, so that after cutting of the double cigarette the burn additive profile is nominally identical on the visible tobacco rod of all cigarettes.

The invention can also be applied to cigarettes that do not contain a filter. In this case, position x=0 is the mouth end of the cigarette and x=L is the end of the cigarette opposite to the mouth end.

With respect to the selection of the base cigarette paper, i.e. the initial cigarette paper that according to the invention should be provided with a position-dependent burn additive content, no restrictions apply, which means that all cigarette papers known in the prior art can be used for the realization of the invention, also colored papers or papers with treated areas, which can produce the self-extinguishing properties of a cigarette manufactured therefrom.

Preferred base cigarette papers for the invention consist of pulp fibers that can be produced from wood, flax, hemp, esparto grass or other materials. In addition, mixtures of pulp fibers of different origin can be used. Preferred base cigarette papers have a basis weight of 10 $g/m^2$ to 60 $g/m^2$, wherein the range from 20 $g/m^2$ to 35 $g/m^2$ is particularly preferred.

The preferred base cigarette paper also contains inorganic, mineral filler materials that are added to the paper in an amount of 10% by weight to 45% by weight. A particularly preferred filler material is chalk (calcium carbonate), but also other oxides such as magnesium oxide and aluminum hydroxide, and carbonates or mixtures thereof can be used. Precipitated chalk is preferred over geologically sourced chalk because of its purity and more uniform particle size. Cigarette papers without filler material or with less than 10% filler material are also common and can be used for the invention, mainly for non-machine manufactured cigarettes ("Roll-your-own", "Make-your-own"). In addition, cigarette papers with more than 45% filler material are known, but with increasing filler content the tensile strength of the paper decreases and the paper tends to release dust during further processing, for which reason this embodiment is not preferred for use with machine-made cigarettes.

An important parameter for characterizing cigarette paper is its air permeability. It is measured in accordance with ISO 2965 and given in $cm \cdot min^{-1} \cdot kPa^{-1}$. Preferred base cigarette papers in the context of the invention have a natural air permeability, that is without further perforation, from 0 cm $min^{-1}$ $kPa^{-1}$ to 350 cm $min^{-1}$ $kPa^{-1}$, preferably between 20 cm $min^{-1}$ $kPa^{-1}$ and 200 cm $min^{-1}$ $kPa^{-1}$ and particularly preferably between 30 cm $min^{-1}$ $kPa^{-1}$ and 120 cm $min^{-1}$ $kPa^{-1}$.

Perforation or other measures can be used to significantly increase the air permeability, for example to above 300 cm $min^{-1}$ $kPa^{-1}$ or even to above 1000 cm $min^{-1}$ $kPa^{-1}$.

Cigarette papers are typically produced in reels with, for example, a width between 0.3 m and 5 m and cut into bobbins with a width derived from the cigarette circumference of typically 9 mm to 35 mm or an integer multiple of this width.

The known prior art treatment of cigarette paper with burn additives comprises impregnation of the paper on the paper machine in the size or film press with a water-based solution of the burn additive and subsequent drying. Impregnation of the paper on separate equipment provided after the paper machine may also be envisaged.

Processes are also known in which a water-based composition with a particularly high burn additive concentration is applied onto the over-dried paper by means of a flexographic printing station integrated into the paper machine and the paper is then wound up without further drying, These processes produce a nominally constant burn additive content over the entire paper surface and they are not applicable to the present invention without further modification. They can serve, however, to provide the cigarette paper with a constant burn additive content over the surface, so that afterwards the desired profile of the burn additive content can be produced by further steps. As an example, a profile of the burn additive content, applied later, could be superimposed on the constant burn additive content obtained by impregnation or printing. In addition, the reverse sequence of the process is possible, i.e. at first an application of the profile and then impregnation or printing of the cigarette papers which, however, is less preferred, because the previously applied profile could be changed due to wetting of the paper during impregnation or printing.

Preferably, the at least one burn additive is applied to the base cigarette paper in the form of a liquid composition, in particular a solution, suspension or another type of mixture in a solvent. Application can preferably be carried out by a printing process or by spraying.

To produce the desired profile of the burn additive content as precisely as possible, single-layer application is preferred over multi-layer application.

The printing process can be roto-gravure printing or flexographic printing. In the case of roto-gravure printing, a roto-gravure printing cylinder with recesses is preferably provided, from which the composition to be printed is transferred to the base cigarette paper, wherein the volume of the recesses and/or the density of the recesses on the roto-gravure printing cylinder, which can also be called the "mesh size of the recesses", is or are selected such that the desired position-dependent burn additive concentration c(x) results.

Since many substances used as burn additives are water-soluble, modifications of a constant burn additive content as it is generated is possible, for example by impregnation in the size press. Such a modification can be obtained by the selective application of water onto the paper, to dissolve burn additives out of the paper or to move them within the paper. The application can be carried out on a separate apparatus downstream of the paper machine.

In one embodiment an already existing, possibly also constant profile of the content of at least one burn additive in the cigarette paper is modified.

Other process steps, for example printing bands, which is known in the prior art, to obtain self-extinguishing can be carried out before, after or simultaneously with such a treatment of the paper for the production or modification of a profile of the burn additive content.

The composition used for the production of a profile of the burn additive content comprises at least one burn additive and a solvent. Here the term solvent should not be considered to be limited to solutions in the chemical sense. The burn additive can also be present in a suspension or another type of mixture in the solvent. In general, water is preferred as the solvent over organic solvents, because it does not leave any residues in the paper which have a negative effect on the taste of a cigarette and is unproblematic with respect to the risk of fire.

The burn additive content in the composition is at least 0.1% by weight, preferably at least 1% by weight and particularly preferably at least 2% by weight, as well as at most 15% by weight, preferably at most 10% by weight and particularly preferably at most 7% by weight, wherein the values are to be understood as the mass of anhydrous burn additive with respect to the mass of the finished composition.

Optionally, the composition can also contain other substances, for example to adjust the viscosity, in particular polymers, either individually or in an arbitrary mixtures. Examples of such polymers are cellulose derivatives, such as carboxy methyl cellulose, polysaccharides, such as starch or starch derivatives, or in particular alginates, dextrines, guar or gum Arabic. Such substances can, for example, be required for steel printing cylinders for roto-gravure printing coated with chrome, in order to create a film on the printing cylinder by the adjusted viscosity, so that the doctor blade in contact with the printing cylinder does not scratch the printing cylinder. For printing cylinders coated with ceramics, such substances in the composition may be omitted under certain circumstances. The viscosity of the composition can be characterized by the flow time; for roto-gravure printing, for example, it will be selected to be between 10 s and 40 s, preferably between 12 s and 35 s, measured as flow time out of a cup with an opening of 4 mm according to ÖNORM EN ISO 2431:2011. The measurement of the flow time in this regard should be carried out at the temperature at which the composition is used in the application process.

In order to obtain a certain content of the at least one burn additive in the cigarette paper, the applied amount of the composition must be adjusted to the initial basis weight of the cigarette paper, that is to the basis weight before application of the composition. The applied amount of composition should be at most 100% of the initial basis weight, preferably at most 80% and particularly preferably at most 60%. The upper limit thereby results mainly from the amount of composition that can be applied to a cigarette paper without substantially deleteriously affecting its processability, for example due to the reduced tensile strength in the wet state. A lower limit results from the possibilities of the application process and is at least 0% of the initial basis weight, preferably at least 0.5% and particularly preferably at least 1%. Areas to which no composition is applied can, of course, also be provided.

To dry the cigarette paper after application of the composition, any type of dryer can be used, for example, hot air dryers, infra-red dryers, tunnel dryers, heated drying cylinders and also drying by micro-waves.

Drying of the cigarette paper after application of a water-based composition is preferably carried out by contact with one or more heated drying cylinders. Treating the paper with a water-based composition frequently leads to the formation of wrinkles in the paper that can be efficiently reduced by drying with a drying cylinder. As additional measures, one or more spreader rolls or smoothing devices can be provided for pulling the wrinkles out of the paper and are preferably arranged such that the paper runs over one or more spreader rollers or smoothing devices before contact with the first drying cylinder. Alternatively, but less preferred, the spreader rollers or smoothing devices are arranged after one or more drying cylinders. For compositions that are not water-based this technology can, of course, also be used, however in this case the problem with the formation of wrinkles does not occur or only to a substantially lesser extent.

Other parameters that need to be set for application of the composition in printing processes or other processes, for example, temperatures, viscosities, speeds or the design of the printing cylinder can readily be found by the skilled person with the help of his expert knowledge.

Many application processes also allow the content of at least one burn additive to be varied, not only in the longitudinal direction of the paper, i.e. in direction of the longitudinal axis of a cigarette to be manufactured therefrom, but also in the transverse direction, i.e. in the circumferential direction of the cigarette to be manufactured.

For the present invention only the average content in the circumferential direction of the at least one burn additive is important, for which reason the content of the at least one burn additive in the cigarette paper it essentially constant in the transverse direction, i.e. in the circumferential direction on a cigarette manufactured from the paper according to the invention. In this manner, uneven smoldering of the cigarette over its circumference, and ash or tobacco falling out or deterioration of the ash appearance is avoided.

DETAILED DESCRIPTION ON THE INVENTION

Figure 1:
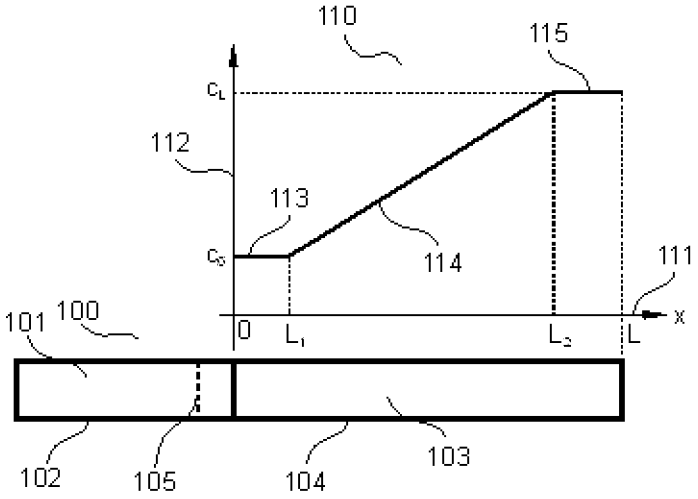
FIG. 1 shows a cigarette and arranged above it is a diagram of an exemplary profile of the content of the at least one burn additive.

Some examples will now demonstrate the desired effect according to the invention.

Tri-sodium citrate was applied as a burn additive to a cigarette paper with a basis weight of 30 g/m$^2$ from wood pulp, a content of precipitated chalk as filler of 30% of the paper mass and an air permeability of 50 cm $min^{-1}$ $kPa^{-1}$, according to ISO 2965.

More precisely, a water-based solution of the burn additive was produced, as is also prepared for impregnation of the paper as is known in the prior art. The burn additive content in the solution resulted thereby from the desired profile of the content in the cigarette paper and the requirements of the application process.

Cigarettes with the following properties were manually produced from the cigarette paper:

| | |
|---|---|
| Diameter | 7.8 mm |
| Length of the cigarette | 84 mm |
| Length of the filter | 24 mm |
| Filter | cellulose acetate |
| Length of the tipping paper | 32 mm |
| Filler weight of the tobacco rod | 750 mg |
| Tobacco blend | American blend |

In this regard, firstly, long tubes of cigarette paper were prepared and cut such that the profile of the burn additive corresponded to the desired profile on a cigarette manufactured therefrom. Then the tubes were filled with tobacco and a filter plug was attached to the tube, filled with tobacco, by means of a tipping paper.

For each profile of the burn additive content, 60 cigarettes were machine-smoked according to ISO 4387 and the tar and nicotine generated in each puff were collected in a Cambridge Filter Pad. Tar and nicotine were determined for each puff from the analysis of the Cambridge Filter Pad.

From the content of tar and nicotine in each puff, the mean value (M) in mg over all puffs, the coefficient of variation (CoV) as a % over all puffs and the ratio V of the content between the last and first puff were calculated. The coefficient of variation in this regard is the standard deviation of the respective smoke yield over all puffs of a cigarette divided by its mean value and expressed as percentage. The profiles of the burn additive content according to the function f(x) are characterized by the parameters $c_0$, $c_L$, $L_1$ and $L_2$ and are shown in Table 1 together with the results.

TABLE 1

| | Profile | | | | Tar | | | Nicotine | | |
|---|---|---|---|---|---|---|---|---|---|---|
| No. | $c_0$ % | $c_L$ % | $L_1$ mm | $L_2$ mm | M mg | CoV % | V | M mg | CoV % | V |
| 1 | 1.4 | 1.4 | 0 | 52 | 1.25 | 16.1 | 1.62 | 0.075 | 11.6 | 1.41 |
| 2 | 0.7 | 0.0 | 0 | 52 | 1.33 | 13.0 | 1.47 | 0.082 | 7.6 | 1.25 |
| 3 | 1.4 | 0.0 | 0 | 52 | 1.30 | 12.5 | 1.44 | 0.080 | 6.4 | 1.20 |
| 4 | 2.0 | 0.0 | 0 | 52 | 1.29 | 13.5 | 1.47 | 0.078 | 6.8 | 1.20 |
| 5 | 2.7 | 0.0 | 0 | 52 | 1.31 | 16.0 | 1.56 | 0.078 | 8.9 | 1.25 |
| 6 | 3.5 | 0.0 | 0 | 52 | 1.35 | 19.9 | 1.70 | 0.080 | 12.5 | 1.35 |
| 7 | 2.7 | 2.5 | 0 | 52 | 1.52 | 9.4 | 1.32 | 0.086 | 6.6 | 1.21 |
| 8 | 2.0 | 3.5 | 0 | 52 | 1.45 | 7.1 | 1.23 | 0.082 | 4.8 | 1.15 |
| 9 | 1.4 | 3.5 | 0 | 52 | 1.40 | 6.2 | 1.18 | 0.080 | 4.5 | 1.12 |
| 10 | 0.7 | 3.5 | 0 | 52 | 1.37 | 6.9 | 1.18 | 0.079 | 6.1 | 1.15 |
| 11 | 0.0 | 3.5 | 0 | 52 | 1.36 | 9.3 | 1.23 | 0.080 | 9.1 | 1.22 |
| 12 | 1.4 | 3.5 | 10 | 40 | 1.41 | 4.9 | 1.18 | 0.081 | 3.9 | 1.13 |
| 13 | 1.4 | 3.5 | 5 | 45 | 144 | 4.5 | 118 | 0.083 | 3.4 | 1.13 |

Profile No. 1 corresponds to a constant burn additive content of 1.4% and serves for comparison. It can be seen by means of the ratio V that there is a significant increase in the tar content of 62% and in the nicotine content of 41%. The coefficients of variation of tar and nicotine are 16.1% and 11.6%.

The profiles 2 to 6 show a burn additive content that decreases from the mouth end to the cigarette tip, while the profiles 7 to 13 correspond to an increasing burn additive content. For the profiles 12 and 13 the burn additive is constant over a length of 10 mm or 5 mm, respectively, at the mouth end and at the cigarette tip, and in between it increases linearly.

It can be seen from table 1 that for the profiles 2-5 and 7-13, the coefficient of variation of the tar content as well as the ratio of the tar contents between the last and the first puff is less than for a comparative cigarette with the constant profile of example 1. As regards the nicotine content, all of the profiles 2-13 exhibited an improvement over the comparative cigarette with respect to the coefficient of variation of the nicotine content or with respect to the ratio of the nicotine content between the last and first puff.

It can also be seen that for profiles 2-6, with decreasing burn additive content along the tobacco rod, only smaller improvements could be obtained than with the increasing profiles 7-11. This holds for tar as well as for nicotine. As an example, for profiles 2-6 the lowest coefficient of variation of the tar content could be obtained with 12.5% for profile 3, i.e. a decrease from 1.4% to 0% burn additive content, while the same parameter is below this value for all profiles 7-11, and reached a minimum of 6.2% for profile 9, an increase from 1.4% to 3.5% burn additive content.

In this regard, the effect that a constant content of about 1.5% to 3.0% tri-sodium citrate results in a minimum for tar and nicotine values is exploited.

Both profiles 2-6 decreasing in direction towards the cigarette tip, x=L, as well as profiles 7-13, increasing in this direction, exploit the effect that a burn additive content that leads to lower tar and nicotine values is present close to the filter end, where the "strong" puffs are generated.

In comparison to the other examples, it turns out that the profiles 6 and 11 are less preferred, because for these profiles the burn additive content at the filter end, with 3.5% for profile 6 and with 0% for profile 11, deviates significantly from that burn additive content for which minimum tar and nicotine values can be obtained. For these two profiles the possibilities for stabilizing the puff profile have not been fully utilized.

Generally, the burn additive content in the area of the filter end can thus almost be selected such that it leads to a minimization of a certain smoke yield, in particular tar or nicotine, for an otherwise identical cigarette with constant burn additive content, and starting from this value increases or decreases monotonically or approximately monotonically in the direction towards the cigarette tip. The term "almost be selected such" should also allow for deviations from the ideal value of the burn additive concentration that are less than 50%, preferably less than 30%, particularly less than 15% of the ideal value. In addition, the term "otherwise identical cigarette" for a cigarette means that it is produced from the same base cigarette paper or from a base cigarette paper that is similar inasmuch as the basis weight deviates by at most 20% and the mean air permeability, according to ISO 2965, deviates at most 15% from the same base cigarette paper. Particularly good results were found for the two profiles 12 and 13 for which, in addition to a linear increase from 1.4% to 3.5% burn additive content, areas with constant burn additive content of 1.4% and 3.5%, respectively, are provided on a length of 5 mm or 10 mm at the mouth end and at the cigarette tip. Although hardly any improvements can be obtained in the ratio of the tar and nicotine content between the last and the first puff compared with examples 2-11, the coefficient of variation of tar and nicotine can be further reduced and reaches values of 4.9% and 4.5% for tar and 3.9% and 3.4% for nicotine.

The particularly preferred embodiment of examples 12 and 13 is shown in FIG. 1. An exemplary cigarette 100 consists of a filter 101, wrapped with a tipping paper 102 that partially overlaps the tobacco rod 103 that in turn is wrapped with a cigarette paper 104. On the cigarette 100, the tipping paper 102 is located in an overlapping zone over the cigarette paper 104. The dashed line 105 indicates the boundary between the filter and the tobacco rod, so that the overlapping zone runs from the dashed line 105 to the position x=0 along the cigarette axis. The diagram 110 arranged over the cigarette 100 in FIG. 1 shows an exemplary profile of the content of the at least one burn additive. The x-axis 111 shows the position x=0 at the start of the visible tobacco rod and the position x=L at the end of the cigarette to be lit. The y-axis 112 shows the content of the at least one burn additive. At first the content of the at least one burn additive is constant at a level $c_0$ in the range from x=0 to $x=L_1$, reference numeral 113, and then it increases linearly in the range from $x=L_1$ to $x=L_2$ from the level $c_0$ to the level $c_L$, reference numeral 114, and then remains at the level $c_L$ up to the position x=L, reference numeral 115. Of course, this is an idealized profile, from which deviations are possible in reality, for example by the usual production tolerances or inhomogeneities of the paper.

Figure 2:
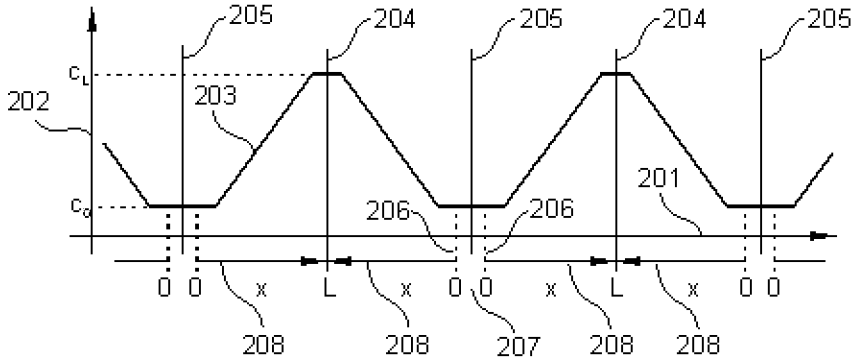
FIG. 2 shows an exemplary profile of the content of the at least one burn additive along the cigarette paper, as it results from the common machine-made cigarette production process.

During the machine manufacture of cigarettes, an endless tobacco rod is formed that is cut into pieces, that have the length of the tobacco rod on the cigarette. Between two such pieces a filter plug of double length is inserted and adhered to a tipping paper of double width, so that a double cigarette connected at the filter end is created. In a final cut the double cigarette is divided in two cigarettes and one of the two cigarettes is flipped over so that all cigarettes running out of the cigarette machine are identically oriented. It follows that there is a need for appropriate selection of the profile of the content of the at least one burn additive along the cigarette paper web. Such an exemplary profile is shown in FIG. 2.

The main direction of the cigarette paper, typically the machine direction, is indicated by arrow 201. The direction 202 indicates the content of the at least one burn additive and its profile in the direction 201 is indicated by line 203. On the cigarette machine a piece of tobacco rod is produced by a cut at each of the positions indicated by lines 204 and 205. The area 207 delimited by the dashed lines 206 is located under the tipping paper on a double cigarette and is therefore not visible during normal use. In this area 207 the profile of the content of the at least one burn additive is not important, because this area is typically not smoked. The x-axes 208 indicate the course of the x-coordinate from position x=0 to position x=L for each of the cigarettes manufactured from the tobacco rod. Because a double cigarette is produced with a subsequent cut along the lines 204 and 205 and flipping over of the cigarette, it is necessary that along direction 201 an increasing and a decreasing profile alternate periodically, if the profile of the content of the at least one burn additive is to be permanently nominally identical in the area of the visible tobacco rod on the manufactured cigarettes.

In order to synchronize cutting of the tobacco rod with the profile 203 of the content of the at least one burn additive, marks are employed at the positions indicated by lines 205, i.e. in the area 207, as the areas 207 will be overlapped by the tipping paper on the cigarette and hence the marks are not visible.

Of course, this is just an exemplary profile and it is simple for the skilled person for any desired profile of the at least one burn additive on the cigarette to determine the corresponding profile on the cigarette paper web depending on the production process of the cigarette.

Applying the burn additives according to the invention also brings about changes in the overall tar and nicotine content even compared to the comparative cigarette with the constant profile of example 1. These changes, however, can easily be compensated for by adjustment of the filter ventilation or the filter, without impairing the effect according to the invention.

By means of these examples, the skilled person will be able to work out a profile for the content of at least one burn additive for a large class of burn additives with little experimental effort, so that the invention can easily be transferred to various burn additives. In addition, he/she will be able to work out a desired profile of the content of at least one burn additive for diverse cigarette papers and cigarette designs.

The invention claimed is:

1. Cigarette paper comprising at least one burn additive that increases or reduces a smoldering speed of the cigarette paper, wherein:

a concentration c(x) of the at least one burn additive varies along a direction x of the cigarette paper, a position-dependent concentration c(x) over an interval of length L for x over the interval [0,L] is:

$$f(x)-\Delta c \le c(x) \le f(x)+\Delta c$$

wherein:

3 cm≤L≤1 cm, f(x) is monotonic over the interval [0,L], but is not a constant function over the entire interval, Δc≤1% by weight and Δc≥0% by weight, respectively with respect to the mass of the cigarette paper, $|f(L)-f(0)| \ge 2\Delta c$, the air permeability of the cigarette paper comprising the at least one burn additive is between 20 cm $min^{-1}$ $kPa^{-1}$ and 200 cm $min^{-1}$ $kPa^{-1}$, and the at least one burn additive comprises at least one of: tri-sodium citrate, tri-potassium citrate, further citrates, malates, tartrates, acetates, nitrates, succinates, fumarates, gluconates, glycolates, lactates, oxylates, salicylates, α-hydroxy caprylates, or mixtures thereof.

2. Cigarette paper according to claim 1, wherein Δc≤0.7% by weight.

3. Cigarette paper according to claim 1, wherein $|f(L)-f(0)| \ge 0.5\%$ by weight.

4. Cigarette paper according to claim 1, wherein the function f(x) is defined as:

$$f(x)=\begin{cases} c_0 & 0 \le x \le L_1 \\ c_0+(c_L-c_0)\dfrac{x-L_1}{L_2-L_1} & L_1 < x < L_2 \\ c_L & L_2 \le x \le L \end{cases}$$

wherein $L_1$ and $L_2$ are boundaries of intervals between 0 and L, $c_0$ is the concentration at point 0, and $c_L$ is the concentration at point L.

5. Cigarette paper according to claim 4, wherein $c_0$ or $c_L$ are greater than or equal to 0.2% by weight and ≤15.0% by weight, wherein in each case $c_0$ and $c_L$ are different from each other.

6. Cigarette paper according to claim 4, wherein $L_1 \le 2L/3$ and $L_1 \ge L/6$.

7. Cigarette paper according to claim 4 wherein, further: $L_2 \ge L/3$ and $L_2 \le 5L/6$, wherein $L_1 \le L_2$ always holds.

8. Cigarette paper according to claim 4 wherein, further: $L_2-L_1 \ge L/6$ and $L_2-L_1 \le 9L/10$.

9. Cigarette paper according to claim 1, with at least one mark, positioned on the cigarette paper in a pre-determined spatial relationship to the function c(x), wherein the mark is detectable by an optical sensor.

10. Cigarette paper according to claim 9, intended for a filter cigarette and wherein the mark is at a position that is located under the tipping paper on a filter cigarette that is manufactured therefrom or where the mark is applied to the side that is facing away from the tobacco on a finished cigarette.

11. Cigarette paper according to claim 1, wherein the described profile c(x) varies periodically, alternating in normal and reverse directions.

12. Cigarette paper according to claim 1, wherein the cigarette paper comprises pulp fibers or a mixture of pulp fibers, wherein the pulp fibers have been sourced from wood, flax, hemp or esparto grass, wherein the cigarette paper has a basis weight from 10 $g/m^2$ to 60 $g/m^2$.

13. Cigarette paper according to claim 1, further comprising an inorganic mineral filler, wherein the inorganic mineral filler comprises at least one of chalk, magnesium oxide, aluminum hydroxide, carbonates or mixtures thereof.

14. The cigarette paper of claim 1 wherein $\Delta c \le 0.5\%$ by weight.

15. The cigarette paper according to claim 1, in which $\Delta c \le 0.5\%$ by weight and $|f(L)-f(0)| \ge 2.0\%$ per weight.

16. The cigarette paper according to claim 1, in which $\Delta c \le 0.3\%$ by weight and $|f(L)-f(0)| \ge 1.0\%$ per weight.

17. Process for producing a cigarette paper comprising:

providing a base cigarette paper, and introducing at least one burn additive that increases or reduces a smoldering speed of the cigarette paper to arrive at the cigarette paper of claim 1.

18. Process according to claim 17, wherein $\Delta c \le 0.7\%$ by weight.

19. Process according to claim 17, wherein the at least one burn additive is applied to the base cigarette paper in the form of a liquid composition by a printing process or by spraying.

20. Process according to claim 19, wherein the printing process is roto-gravure printing or flexographic printing.

21. Process according to claim 20, providing a roto-gravure printing cylinder with recesses from which the composition printed is transferred to the base paper, wherein the volume of the recesses and/or the density of the recesses on the roto-gravure printing cylinder are selected such that the desired position-dependent concentration c(x) of the burn additive is obtained.

22. Process according to claim 20, wherein the flow time of the composition is 10 s to 40 s measured in accordance with ÖNORM EN ISO 2431:2011 with a cup with an opening of 4 mm at the temperature the composition is used in the application process.

23. Process according to claim 19, wherein the content of the at least one burn additive or burn additive mixture in the composition is at least 0.1% by weight and at most 15% by weight with respect to the mass of the composition.

24. Process according to claim 19, wherein the composition contains polymers or a mixture of polymers for adjusting the viscosity, wherein the polymers are a cellulose derivative, and are chosen from a group consisting of carboxy methyl cellulose, a polysaccharide, starch or starch derivatives, an alginate, a dextrin, guar or gum Arabic or combinations thereof.

25. Process according to claim 19, wherein the applied amount of the composition per unit area corresponds to at most 80% of the corresponding initial basis weight before application of the composition.

26. Process according to claim 19, further comprising a step of drying the cigarette paper after application of the composition using one of a hot air dryer, an infra-red dryer, a tunnel dryer, by heated drying cylinders or the use of micro-waves.

27. Process according to claim 26, wherein the composition is water-based and drying is carried out by contact with one or more drying cylinders that are heated, wherein one or more spreader rollers or smoothing devices are provided configured for pulling wrinkles out of the paper during drying and arranged such that the paper runs over one or more spreader roller(s) or smoothing device(s) before the drying cylinder.

28. Process according to claim 17, wherein at least a part of the at least one burn additive is introduced by impregnation of the paper:

a) in a size or film-press of a paper machine, or b) in equipment downstream of the paper machine with a solution of the burn additive.

29. Process according to claim 17, wherein the at least one burn additive is initially introduced to the paper with an approximately uniform concentration and then washed out in a position-dependent manner, in order to obtain the desired position-dependent burn additive concentration.

30. Cigarette comprising:

a tobacco rod; and a cigarette paper, according to claim 1, that surrounds the tobacco rod.

* * * * *